US006416372B1

(12) United States Patent
Nozue

(10) Patent No.: US 6,416,372 B1
(45) Date of Patent: Jul. 9, 2002

(54) OUTBOARD MOTOR COOLING SYSTEM

(75) Inventor: Toshihiro Nozue, Shizuoka (JP)

(73) Assignee: Sanshin Kogyo Kabushiki Kaisha (JP)

( * ) Notice: Subject to any disclaimer, the term of this patent is extended or adjusted under 35 U.S.C. 154(b) by 0 days.

(21) Appl. No.: 09/440,777

(22) Filed: Nov. 16, 1999

(30) Foreign Application Priority Data

Nov. 16, 1998 (JP) ..... 10-324302
Nov. 16, 1998 (JP) ..... 10-324303

(51) Int. Cl.[7] ..... B63H 21/10
(52) U.S. Cl. ..... 440/88
(58) Field of Search ..... 440/88, 89; 123/195 P

(56) References Cited

U.S. PATENT DOCUMENTS 3,493,081 A * 2/1970 Tado ..... 184/104
4,452,194 A 6/1984 Watanabe
4,498,875 A 2/1985 Watanabe
4,523,556 A 6/1985 Suzuki
4,562,797 A 1/1986 Suzuki
4,611,559 A 9/1986 Sumigawa
4,709,671 A 12/1987 Sugimura
4,828,519 A 5/1989 Watanabe
5,072,809 A 12/1991 Shibata
5,118,316 A 6/1992 Kakizaki et al.
5,149,284 A 9/1992 Kawai
5,215,164 A 6/1993 Shibata
5,232,387 A * 8/1993 Sumigawa ..... 440/88
5,439,404 A * 8/1995 Sumigawa ..... 440/88
5,462,464 A * 10/1995 Ming ..... 440/88
5,487,688 A 1/1996 Sumigawa
5,549,492 A 8/1996 Yamamoto et al.
5,647,315 A 7/1997 Saito
5,704,819 A 1/1998 Isogawa
5,733,157 A 3/1998 Okuzawa et al.
5,752,866 A 5/1998 Takahashi et al.
5,769,038 A * 6/1998 Takahashi et al. .... 123/41.82 R
5,778,847 A 7/1998 Takahashi et al.
5,778,848 A 7/1998 Takahashi et al.
5,809,963 A 9/1998 Saito
5,876,188 A 3/1999 Okamoto
5,876,256 A * 3/1999 Takahashi et al. ..... 440/1
5,893,783 A * 4/1999 Hiraoka et al. ..... 440/88
5,921,829 A * 7/1999 Iwata ..... 440/88
5,924,901 A 7/1999 Takahashi et al.
5,934,957 A * 8/1999 Sato et al. ..... 440/88
5,934,960 A 8/1999 Katayama et al.
5,937,801 A * 8/1999 Davis ..... 123/41.33
5,980,340 A 11/1999 Okamoto
6,012,956 A * 1/2000 Mishima et al. ..... 440/88
6,033,273 A 3/2000 Nozue et al.
6,039,618 A * 3/2000 Hiraoke et al. ..... 440/89
6,053,784 A 4/2000 Takahashi
6,059,619 A 5/2000 Nozue
6,082,343 A * 7/2000 Oishi et al. ..... 123/572
6,126,499 A * 10/2000 Katayama et al. ..... 440/88

* cited by examiner

*Primary Examiner*—S. Joseph Morano
*Assistant Examiner*—Ajay Vasudeva
(74) *Attorney, Agent, or Firm*—Knobbe, Martens, Olson & Bear, LLP.

(57) ABSTRACT

An outboard motor cooling system includes an improved construction to enhancing cooling of the lubrication system, and more particularly, an oil pan of the lubrication system. The oil pan depends from an engine of the outboard motor and into a driveshaft housing. A periphery coolant jacket is provided around the oil pan. A water pool is defined between the oil pan and the driveshaft housing. An exhaust manifold passes through in a hollow of the oil pan and a water curtain is defined between the hollow wall and the exhaust manifold. An upstanding water passage is also disposed through the oil pan. At least one of an upper and lower transverse water jacket extends transversely above or below the oil pan. No drain water from the engine flows through these jackets or passages. The oil pan therefore is sufficiently cooled. In addition, the upper transverse water jacket increases protection of engine components from heat deterioration.

61 Claims, 13 Drawing Sheets

OUTBOARD MOTOR COOLING SYSTEM

PRIORITY INFORMATION

This application is based on and claims priority to Japanese Patent Application No. 10-324303 filed Nov. 16, 1998.

BACKGROUND OF THE INVENTION

1. Field of the Invention

This invention relates to an outboard motor cooling system, and more particularly to an improved cooling system for an oil pan that depends from an engine into a driveshaft housing of an outboard motor.

2. Description of Related Art

An outboard motor generally comprises a drive unit which includes a power head disposed at its top portion, a driveshaft housing depending from the power head and a lower unit further depending from the driveshaft housing. The power head incorporates a powering engine therein and a protective cowling encircling the engine. The driveshaft housing has a driveshaft extending from an output shaft of the engine and downwardly therethrough to the lower unit. The lower unit carries a propulsion device such as a propeller which is mounted on a propeller shaft driven by the driveshaft. The driveshaft housing and the lower unit further contain some sections of an exhaust system for discharging exhaust gasses from the engine outwardly. Actually, exhaust passages and expansion chambers are formed therein and exhaust gasses are discharged to the body of water surrounding the outboard motor through, for example, a hub of the propeller.

The outboard motor further comprises a bracket assembly which includes a swivel bracket and a clamping bracket. The swivel bracket carries the drive unit for pivotal movement about a steering axis extending generally vertically. The clamping bracket is mounted on a transom of an associated watercraft and supports the swivel bracket for pivotal movement about a tilt axis extending generally horizontally.

Some outboard motors recently have employed four-stroke engines as prime movers for such motors. One reason for this tendency is that emissions from a four-stroke engines is cleaner relative to a two-stroke crankcase compression engine. The four-stroke engine typically has a separate oil pan for lubrication of the engine, and usually the oil pan depend from the engine into the driveshaft housing of the outboard motor. Lubricant is pumped to the engine by a lubricant pump and oil drains to the oil pan after lubricating the engine. Because the engine commonly operate at high temperatures, the returning lubricant heats the oil pan.

The outboard motor has a cooling system for cooling the engine with coolant, usually water. More specifically, a water pump is provided in the cooling system and water pumped up by the water pump from the body of water surrounding the outboard motor is delivered to the engine. Conventionally, the cooling system utilizes the same water that has already cooled the engine to cool the oil pan. For this purpose, the oil pan is usually surround by a coolant pool through which the water that has circulated through at least a portion of the engine flows. The coolant pool is formed between an outer wall of the oil pan and an inner wall of the driveshaft. Because the water is already hot, however, the oil pan is not significantly cooled. As a result, an outer wall of the driveshaft is likely to be heated, and can become discolored. This harms the appearance of the outboard motor.

In addition, an exhaust manifold, which is one of the sections of the exhaust system, is positioned to pass through the oil pan. The exhaust gasses flowing through this exhaust manifold also are hot and further heat the oil pan. The heat sink provided by the water passing through the coolant pool in a conventional system therefore may not be sufficient to prevent discoloration of the driveshaft housing and overheating of the lubricant.

Other components of the outboard motor also are affected by the elevated temperature of the oil pan within the drive shaft housing. For instance, such heat may also affect an upper mount of the steering assembly. The steering assembly includes both an upper mount and a lower mount, which are affixed on the drive unit to pivotally support it on the swivel bracket. A steering shaft extends through forward portions of the respective mounts and a steering shaft housing disposed at the rear of the swivel bracket. Rear portions of the respective mounts are affixed to the forward portion of the driveshaft housing so as to be spaced apart vertically from each other. The rear portions contain elastic elements to absorb vibrations generated by the engine and the propeller or shocks exerted upon the drive unit, and to prevent transfer of such to the associated watercraft. The upper mount is usually positioned above and in the proximity to the oil pan. The elastic members of the upper mount tends to be deteriorated by heat transferred from the oil pan. Other components, particularly electrical components, within the protective cowling may be also damaged by the heat.

SUMMARY OF THE INVENTION

The present outboard motor cooling system enhances cooling of the oil pan vis-a-vis conventional outboard motor cooling systems. The cooling system also desirably inhibits discoloration of a driveshaft housing of the outboard motor, as well as deterioration of components positioned above the oil pan, such as, for example, but without limitation, elastic members of an upper mount and engine components.

In accordance with one aspect of the present invention, an outboard motor comprises an internal combustion engine. An oil pan depends from the engine and contains lubricant for lubrication of the engine. A cooling system is provided for cooling at least the engine and the oil pan. The cooling system includes a periphery coolant jacket generally surrounding the oil pan and being supplied with coolant that has not cooled the engine. The cooling system further includes a coolant discharge jacket bypassing the periphery coolant jacket. Coolant that has cooled the engine passes through the coolant discharge jacket.

In accordance with another aspect of the present invention, an outboard motor comprises an internal combustion engine. An oil pan depends from the engine and contains lubricant for lubrication of the engine. A cooling system is provided for cooling at least the engine and the oil pan. The cooling system includes an upstanding coolant passage extending generally vertically through the oil pan and the cooling system supplies coolant to the engine through the upstanding coolant passage.

In accordance with an additional aspect of the present invention, an outboard motor comprises a power head having an internal combustion engine. A housing depends from the power head and supports a propulsion device driven by the engine for propelling an associated watercraft. An oil pan contains lubricant for lubrication of the engine. The oil pan depends into the housing and is spaced from the housing. A cooling system is provided for cooling at least the engine and the oil pan. The cooling system includes a coolant pool defined between the oil pan and the housing. The cooling system supplies coolant that has not cooled the engine to the coolant pool. The cooling system further includes a coolant discharge jacket bypassing the coolant pool. Coolant that has cooled the engine passes through the coolant discharge jacket.

In accordance with another aspect of the present invention, an outboard motor comprises an internal combustion engine. An oil pan depends from the engine and contains lubricant for lubrication of the engine. An exhaust system is provided for discharging exhaust gasses from the engine. The exhaust system includes an exhaust passage that passes through the oil pan. A cooling system is provided for cooling at least the engine and the oil pan. The cooling system includes means for forming a heat sink between the exhaust passage and the oil pan when the engine is operated. In this manner, the amount of heat transfer between the exhaust passage and the oil pan is reduced, i.e., the oil pan and the exhaust passage generally are thermally decoupled from each other.

In accordance with yet another aspect of the present invention, an outboard motor comprises an internal combustion engine. An oil pan depends from the engine and contains lubricant for lubrication of the engine. A cooling system cools at least the engine and the oil pan. The cooling system includes a lower transverse coolant jacket that extends generally transversely below the oil pan. The cooling system supplies coolant that has not cooled the engine. The cooling system further includes a coolant discharge jacket bypassing the lower transverse coolant jacket. Coolant that has cooled the engine passes through the coolant discharge jacket.

In accordance with a further aspect of the present invention, an outboard motor comprises an internal combustion engine. An oil pan depends from the engine and contains lubricant for lubrication of the engine. A cooling system cools at least the engine and the oil pan. The cooling system includes an upper transverse coolant jacket extending generally transversely above the oil pan. The cooling system supplies coolant that has not cooled the engine. The cooling system further includes a coolant discharge jacket bypassing the upper transverse coolant jacket. Coolant that has cooled the engine passes through the coolant discharge jacket.

Further aspects, features and advantages of this invention will become apparent from the detailed description of the preferred embodiment which follow.

BRIEF DESCRIPTION OF THE DRAWINGS

These and other features of this invention will now be described with reference to the drawings of a preferred embodiment which is intended to illustrate and not to limit the invention.

FIG. 6(A) is a side elevational view showing an appearance of the exhaust guide member looked from the position indicated by the arrow 6(A) in FIG. 5. FIG. 6(B) is a cross-sectional, side elevational view thereof taken along the line 6(B)—6(B) in FIG. 5.

FIGS. 8(A), 8(B) and 8(C) are a top plan view, a cross-sectional side view taken along the line 8(B)—8(B) in FIG. 8(A) and a bottom plan view, respectively.

FIGS. 10(A), 10(B), 10(C) and 10(D) are a top plan view, a side view taken along the line 10(B)—10(B) of FIG. 10(A), a bottom plan view and a cross-sectional rear view taken along the line 10(D)—10(D) of FIG. 10(A), respectively.

DETAILED DESCRIPTION OF THE PREFERRED EMBODIMENT OF THE INVENTION

Figure 1:
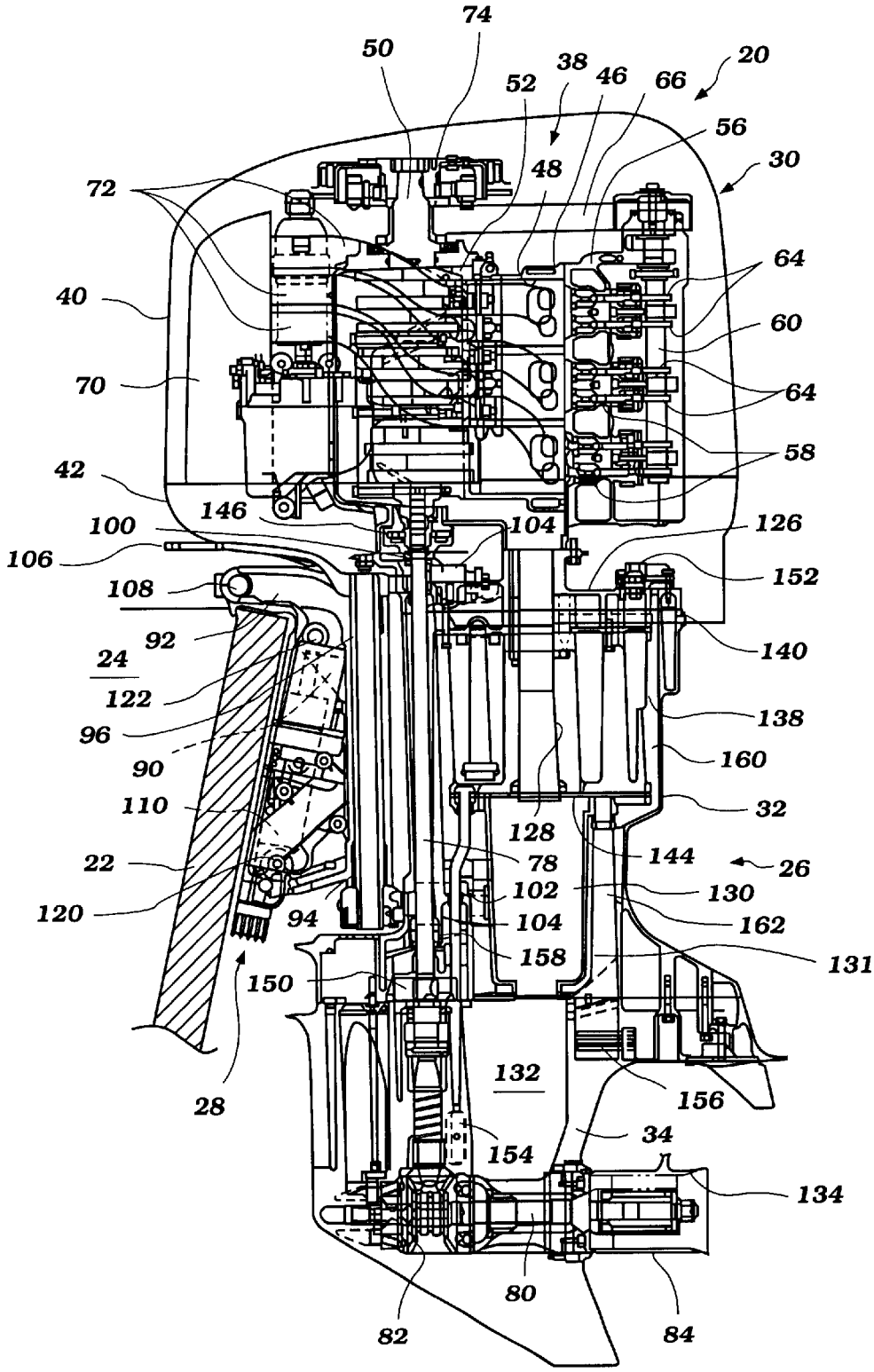
FIG. 1 is a side elevational view showing an outboard motor in accordance with an embodiment of this invention. An engine, a driveshaft housing and a lower unit are shown largely in cross-section and some components are shown in a wire-frame format. An associated watercraft is also shown partially in section.

With reference initially to FIG. 1, the general overall environment of an exemplary outboard motor will be described. In connection with the following description, including the appended claims, the terms "front," "forward" and "forwardly" means at or toward the side where the clamping bracket 92 is located. The terms "rear" and "rearwardly" mean at or toward an opposite side of the front side unless stated otherwise.

An outboard motor 20 is shown as attached to a transom 22 of an associated watercraft 24. The outboard motor 20 generally comprises a drive unit 26 and a bracket assembly 28. The drive unit 26 includes a power head 30, a driveshaft housing 32 and a lower unit 34. The power head 30 is disposed at the top of the drive unit 26 and includes an internal combustion engine 38, a top protective cowling 40 and a bottom protective cowling 42.

The engine 38 is of the V6 type and operates on a four-stroke principle. The engine 38 comprises a cylinder block 46 that is formed with a pair of cylinder banks. Each of these cylinder banks defines three vertically spaced, horizontally extending cylinder bores 48 in which pistons reciprocate. The pistons are, in turn, connected to an output shaft or crankshaft 50 via connecting rods. The crankshaft 50 is journaled for rotation and extends generally vertically within a crankcase 52 which closes a forward opening of the cylinder block 46.

A cylinder head assembly 56 is affixed to the cylinder block 46 to close the other end of the cylinder block 46. The cylinder head assembly 56 defines a plurality of recesses in its inner face. Each of these recesses cooperate with the respective cylinder bore 48 and the head of the piston to define a combustion chamber. The cylinder head assembly 56 has intake ports and exhaust ports. The intake ports are provided for introducing air fuel mixture to the combustion chambers, while the exhaust ports are provided for discharging exhaust gasses from the combustion chambers. Intake valves 58 and exhaust valves (not shown) are provided for opening and closing the intake ports and exhaust ports. A camshaft 60 is journaled on the cylinder head assembly 58 to operate the intake valves 58 and exhaust valves. The intake valves 58 and exhaust valves are opened when cam lobes 64 of the camshaft 60 push them at proper timings. The camshaft 60 is driven by the crankshaft 50 by means of a timing belt 66.

An air induction system is provided for introducing air to the combustion chambers. The air induction system generally comprises a plenum chamber 70 and air intake ducts 72 which correspond to the respective cylinder bores 48. Carburetors or fuel injectors are provided between the plenum chamber 70 and the intake ports for supplying fuel with the air to make an air fuel charge for combustion in the combustion chambers.

Although not shown, spark plugs are affixed on the cylinder head assembly 56 for firing the air fuel charge. A generator 74 is placed at the top of the crankshaft 50 for generating electric power that is applied to the spark plugs and other electrical equipment.

Burnt charges or exhaust gasses are discharged through an exhaust system. Some sections of the exhaust system are contained in the driveshaft housing 32 and will be described below.

Since these types of four stoke engines are well known in the art, a further description is not believed to be necessary to permit those skilled in the art to practice the invention.

The top and bottom cowlings 40, 42 generally completely encircle the engine 38 to protect it. For instance, water is prevented from splashing over the engine 38. The top cowling 40 is detachably affixed to the bottom cowling 42 so as to ensure access to the engine 38 for maintenance.

The driveshaft housing 32 depends from the power head 30 and the lower unit 34, in turn, depends from the driveshaft housing 32. A driveshaft 78 extends generally vertically through the driveshaft housing 32 and is driven by the crankshaft 50. The driveshaft 78 drives a propeller shaft 80 which extends generally horizontally within the lower unit 34 through a forward, neutral, reverse transmission 82 including a bevel gear. The propeller shaft 80 has a propeller 84 at its outer end. Thus, the propeller 84 is powered by the engine 38 through the driveshaft 78 and propeller shaft 80.

The drive unit 26 is mounted on the associated watercraft 24 by the bracket assembly 28 which comprises a swivel bracket 90 and a clamping bracket 92. The swivel bracket 90 carries the drive unit 20 for pivotal movement about the axis of a steering shaft 94 which extends generally vertically through a steering housing section 96 of the swivel bracket 90. An upper mount 100 and a lower mount 102 are affixed on the drive unit 26 to pivotally support it on the swivel bracket 90. That is, the steering shaft 94 extends through forward portions of the respective mounts 100, 102 and the steering shaft housing section 96 disposed at the rear of the swivel bracket 90. The steering shaft 94 is fitted in the forward portions of the respective mounts 100, 102 in spline connections. Meanwhile, rear portions of the respective mounts 100, 102 are affixed to the forward portion of the driveshaft housing 32 so as to be spaced apart vertically from each other. The rear portions of the respective mounts 100, 102 contain elastic elements 104 to absorb vibrations generated by the engine 38 and the propeller 84 or shocks exerted upon the drive unit 26 and prevent them from being conducted to the associated watercraft 24. A steering lever 106 extends forwardly from the upper mount 100 so that an operator of the outboard motor 20 can steer it with the lever 106. A throttle control lever (not shown) may be also attached on the steering lever 106.

The clamping bracket 92 is mounted on the transom 22 of the associated watercraft 24 and supports the swivel bracket 90 for pivotal movement about the axis of a tilt shaft 108. A hydraulic tilt device 110 is affixed between the swivel bracket 90 and the clamping bracket 92 for tilt and trim movements of the drive unit 26.

The hydraulic tilt device 110 comprises a housing having a cavity, a piston slidably supported within the cavity and a piston rod affixed on the piston and extends beyond the cavity. The housing is affixed to a pivot shaft 120 which extends generally horizontally and journaled on a lower portion of the clamping bracket 92 for pivotal movement. The piston rod, in turn, is affixed to a pivot shaft 122 which also extends generally horizontally and is journaled on and between upper portions of the clamping bracket 92 and the swivel bracket 90 for pivotal movement.

When the piston rod expands and contracts with the reciprocal movement of the piston, the drive unit 26 as well as the swivel bracket 90 is tilted up or down within a trim adjusted range or a tilt range. The tilt range exists higher than the trim adjusted range. In the view of FIG. 1, because the drive unit 26 is in a fully trimmed down position, the swivel bracket 90 almost entirely conceals itself within the clamping bracket 92.

The bottom cowling 42 is configured as a tray-shape. At the bottom of the bottom cowling 42, an exhaust guide member 126 is affixed. The engine 38 is anchored to the exhaust guide member 126. An Exhaust manifold 128 depends from the exhaust guide member 126. The exhaust ports of the cylinder head assembly 56 communicate with the exhaust manifold 128. A first exhaust expansion chamber 130 is defined in an expansion chamber member 131 disposed downstream of the exhaust manifold 128 within the driveshaft housing 32. A second expansion chamber 132 is defined downstream of the first expansion chamber 130 and in the lower unit 34.

Exhaust gasses from the exhaust ports of the cylinder head assembly 56 are collected by the exhaust manifold 128 and then flow through the exhaust expansion chambers 131, 132. When passing through the expansion chambers 131, 132, the exhaust gasses are expanded and lose their energy. Exhaust noise is attenuated accordingly. The exhaust gasses are finally discharged to the body of water surrounding the outboard motor 20 through a bore 134 formed in a hub of the propeller 84.

As is typical, the outboard motor 20 includes a lubrication system provided for lubricating engine components. An oil pan 138 depends from the exhaust guide member 126 although a cover member 140 is inserted between the guide member 126 and the oil pan 138. The upper mounts 100 are positioned above and in the proximity to the oil pan 138. Further, engine components exist above the upper mounts 100 within the protective cowlings 40, 42. A lower member 144 is affixed to the bottom of the oil pan 138. The structure of the oil pan 138 including the cover member 140 and the lower member 144 will be described in more detail shortly.

Lubricant is reserved in this oil pan 138 and an lubricant pump 146 is provided around the driveshaft 78 for circulating the lubricant in the oil pan 138 within the engine 38. The lubricant pump 146 is driven by the driveshaft 78.

The lubricant is pumped up from the oil pan 138 by the lubricant pump 146 and circulates around internal portions of the engine for lubrication of engine components such as the crankshaft 74, piston and the camshaft 60. The lubricant then returns to the oil pan 138 again.

The outboard motor 20 further has a cooling system for cooling down heated components including engine components, exhaust system components and the oil pan 138. The water out of and surrounding the motor 20 is utilized as coolant for this cooling system. The cooling system includes a water pump 150, a pressure control valve 152, a water inlet port 154, a water outlet port 156, water supply conduits or jackets and drain conduits or jackets. The water pump 150 is provided around the driveshaft 78 to be driven thereby. Although the cooling system will be described in more detail later, a supply conduit 158, a water pool 160 and drain jacket 162 are shown in FIG. 1.

It should be noted that basically the components including the power head 30 except the top cowling 40, driveshaft housing 32, the lower unit 34, the exhaust guide member 126, the oil pan 138, the cover member 140, lower member 144, the exhaust manifold 128 and the exhaust expansion chamber member 131 are made of metal such as aluminum alloy. In addition, they are assembled with each other by bolt connections whether they are shown or not.

With reference to FIGS. 2 through 11, the structure or construction of the oil pan 138 and the cooling system will be described.

Figure 9A:
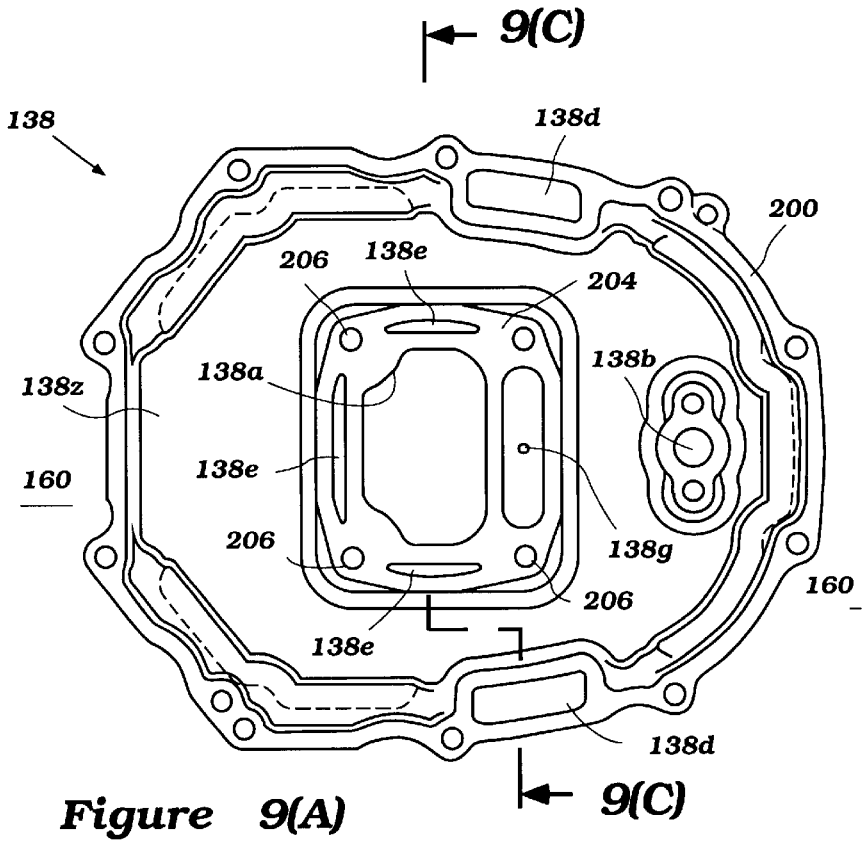
FIGS. 9(A), 9(B) and 9(C) illustrate the oil pan and are a top plan view, a bottom plan view and a cross-sectional rear view taken along the line 9(C)—9(C) of FIG. 9(A), respectively. An oil filter and an exhaust manifold are removed in this figure.
Figure 9B:
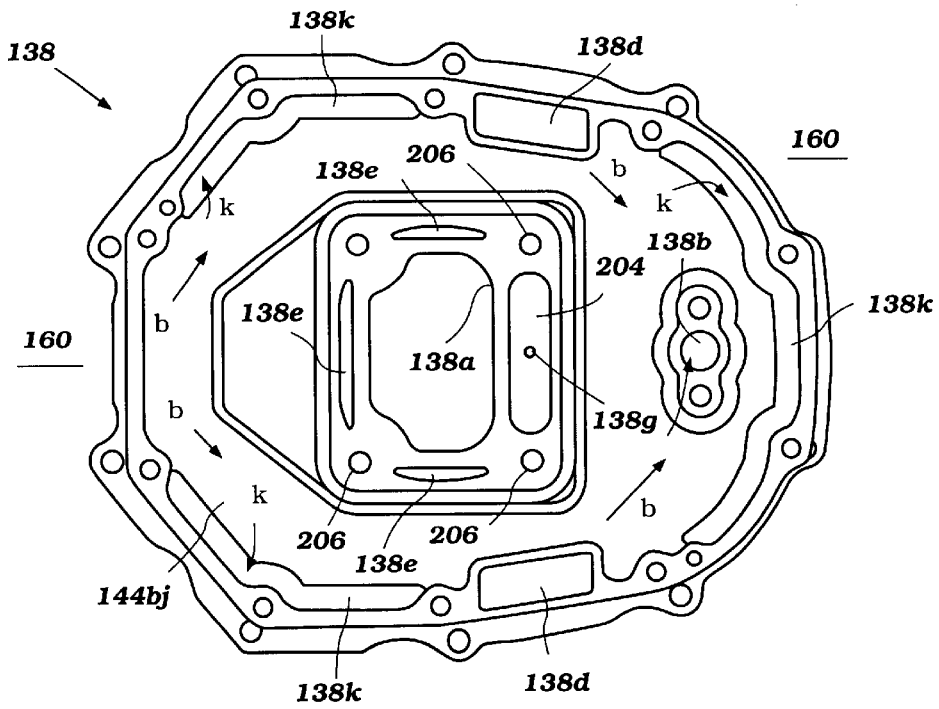
Figure 9C:
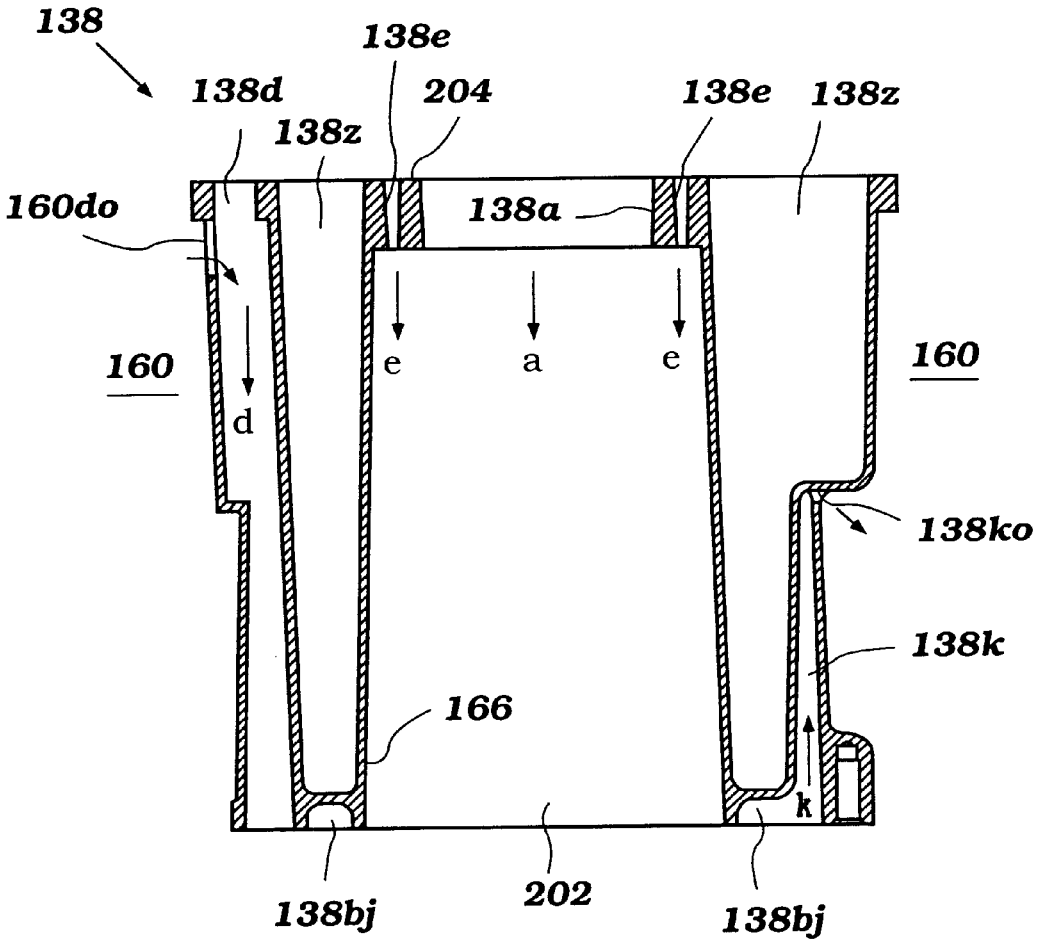

For easy understanding of the exhaust gas flow paths and water channels, these components will be indicated by suffix letters after the respective reference numerals which are assigned in these figures. The respective letters will indicate the specific exhaust gas flow or water channels as follows:

(a): exhaust gas flow;

(b): water channel from the water pump 150 before a branch to the pressure control valve 152;

(c): water channel to the engine 38 after the branch to the pressure control valve 152;

(d): water channel discharged from the engine 38;

(e) and (g): water channel branched off from the channel (c) to an internal wall 166 (see FIG. 9(C)) in the oil pan 138 surrounding the exhaust manifold 128:

(f): water channel branched off from the channel (b) and having the pressure control valve 152;

(k): water channel branched off from the channel (b) to a periphery water jacket 138*k*.

Incidentally, letters (i), (j), (o) and (z) are also assigned to indicate an inlet port, a water jacket, an outlet port and lubricant reservoir, respectively.

Figure 2:
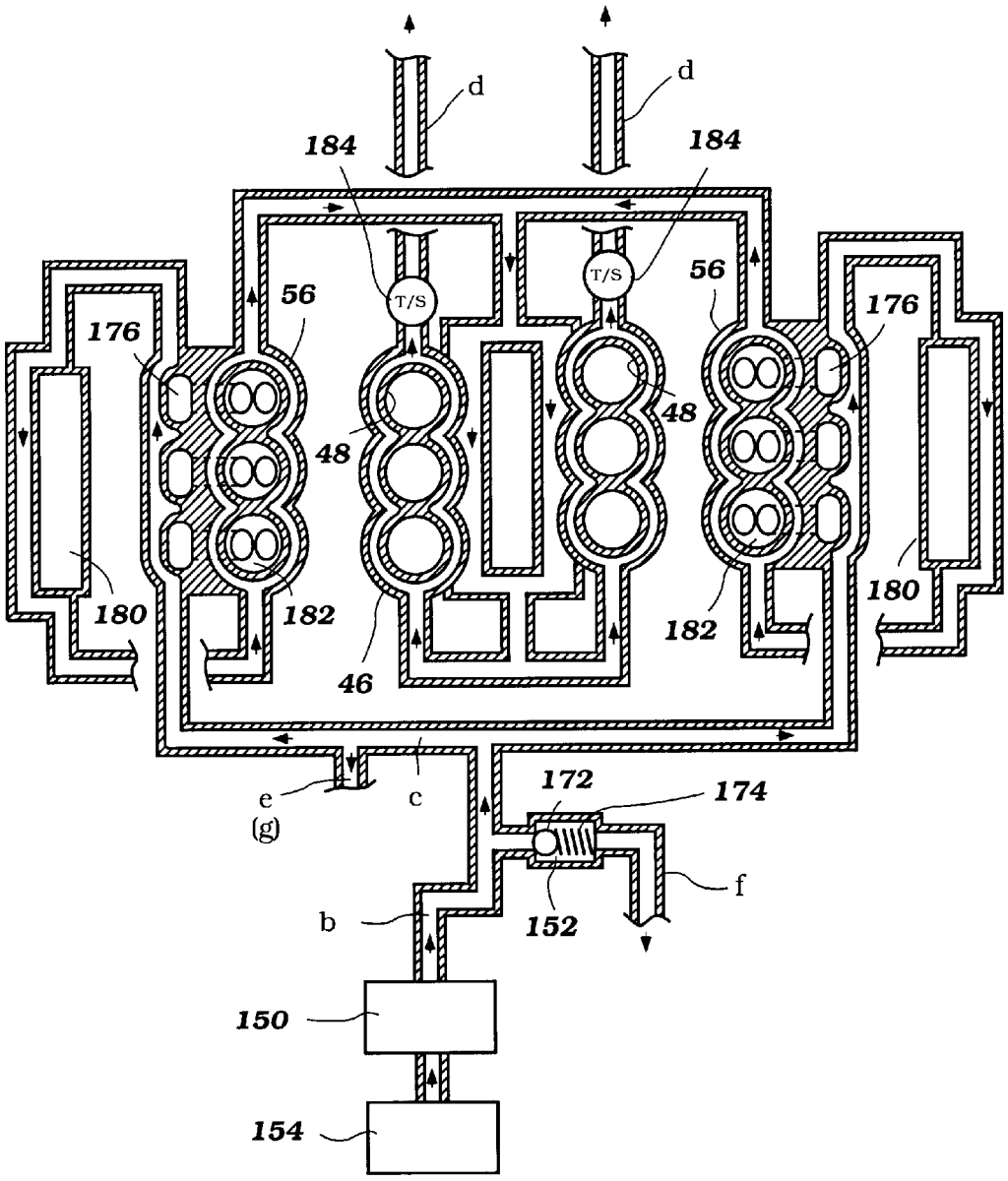
FIG. 2 is a diagram showing a flow of coolant through a cooling system employed in the outboard motor.

With reference to FIG. 2, the flow of cooling water in these channels (a) to (k) will be described. The water is introduced into the cooling system by operation of the water pump 150. The water goes through the channel (b) toward the channel (c). Before reaching the channel (c), some water goes to the pressure control valve 152 in the channel (f). The pressure control valve 152 includes a ball 172 and a spring 174 that urges the ball 172 to close the channel (f) and only permits a water flow from the channel (b) to the channel (f) when the pressure of the water is greater than a preset magnitude. Meanwhile, the water that has reached the channel (c) is directed into one of two banks, each of which goes to exhaust passages 176 of the cylinder bores 48. The water then passes along the periphery of an exhaust collector portion 180 and the combustion chambers 182. The water joins together downstream of the combustion chambers 182 and again is split to the banks and still goes to the respective cylinder bores 48. Downstream of the cylinder bores 48, thermostats 184 are provided in both split channels (c). The thermostats 184 open unless water temperature is lower than a preset value (for example, more than 60° C.) and the water goes to the discharge channel (d). If the water temperature is lower than the preset value, the thermostats 184 will not open (a very small amount can still flow under this condition) and the water pressure exceeds the predetermined magnitude to open the pressure control valve 152. The pressure is relieved accordingly by the pressure control valve 152 and the water, in turn, goes to the channel (f).

It should be noted that the pressure control valve 152 may open for other reasons and that an only condition for opening of the pressure control valve 152 is that the pressure of the water flowing the channels exceeds the preset magnitude.

The actual water channels (b) to (k), as well as the exhaust gas flow (a), will be described by reference to FIGS. 3 through 11.

As seen in FIGS. 4 through 7, the exhaust guide member 126 has a pair of recesses 190 to receive the upper mount 100. A bore 126*a* is formed at almost the center position of the exhaust guide member 126 through which the exhaust gasses flow downwardly. In front of the bore 126*a* and also at both lateral sides of the bore 126*a*, slits 126*e* are formed. Also, behind the bore 126*a*, a pair of openings 126*c* are formed. A pair of discharge openings 126*d* are formed at both outer sides of the lateral slits 126*e* further. The pressure control valve 152 is affixed on the exhaust guide member 126 in a valve chamber 188.

Figure 3:
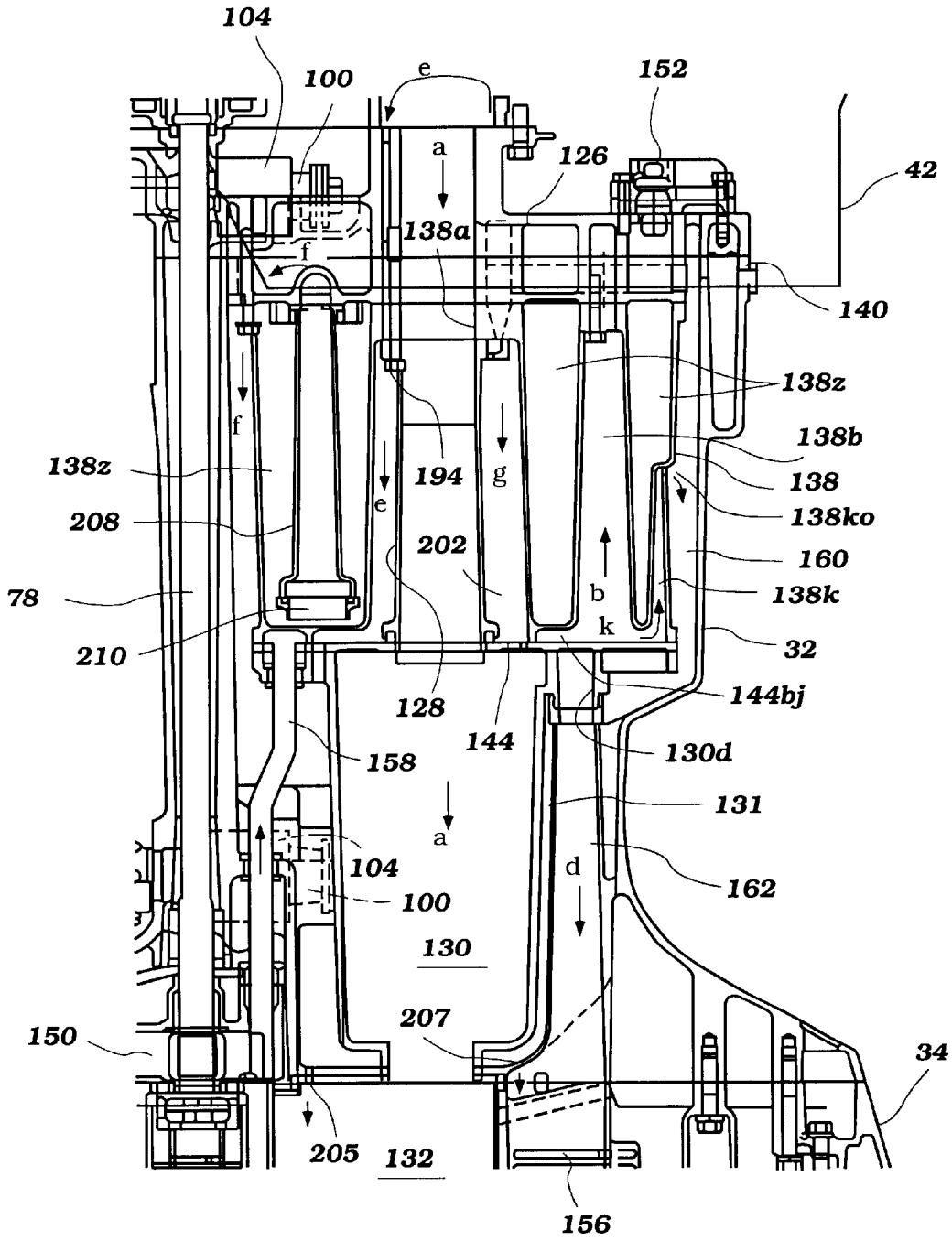
FIG. 3 is an enlarged cross-sectional side view of the driveshaft housing and shows an oil pan and some sections of the cooling system and an exhaust system in the outboard motor. Some components are shown in a wire-frame format again.
Figure 4:
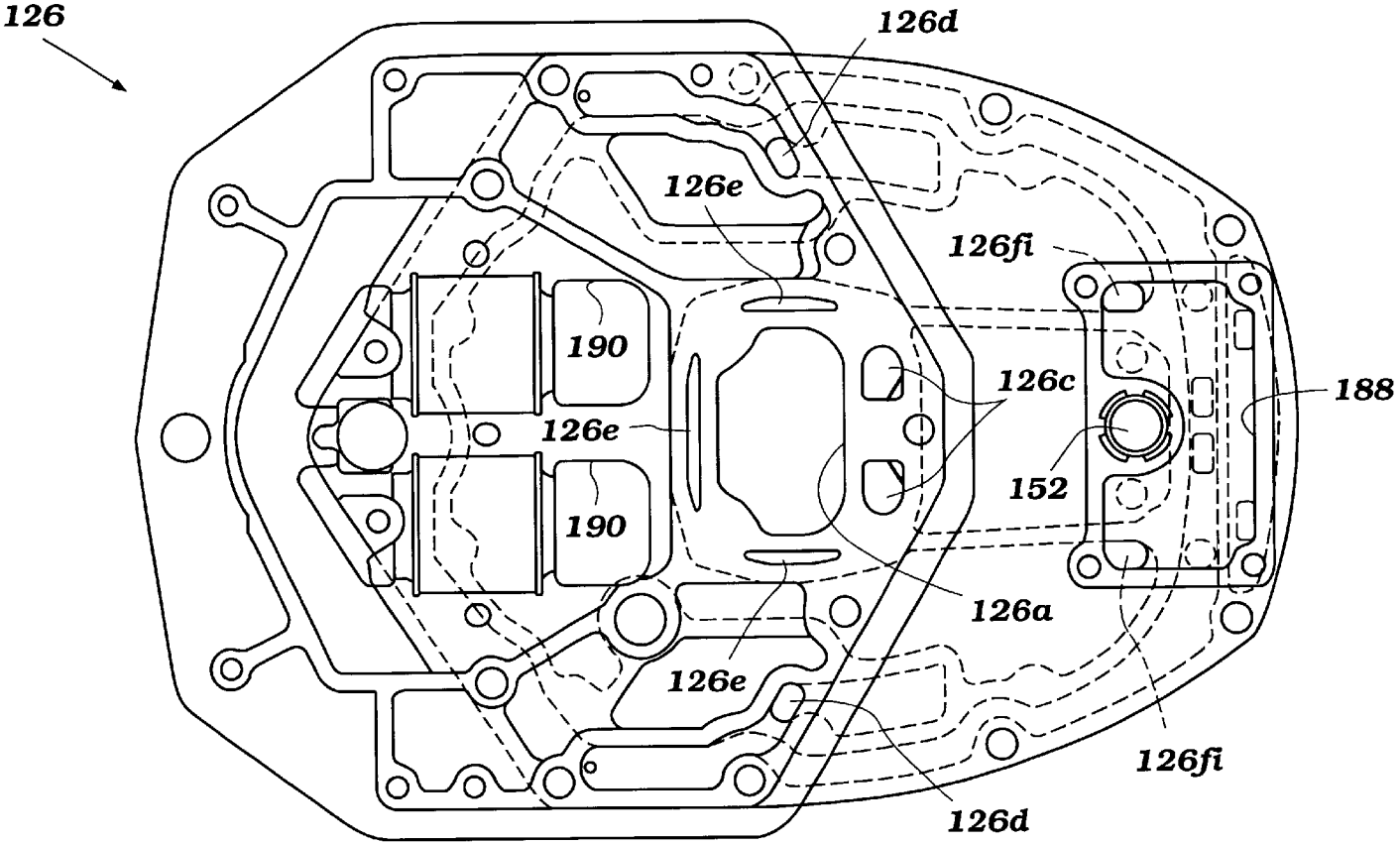
FIG. 4 is a top plan view showing an exhaust guide member of the outboard motor.
Figure 5:
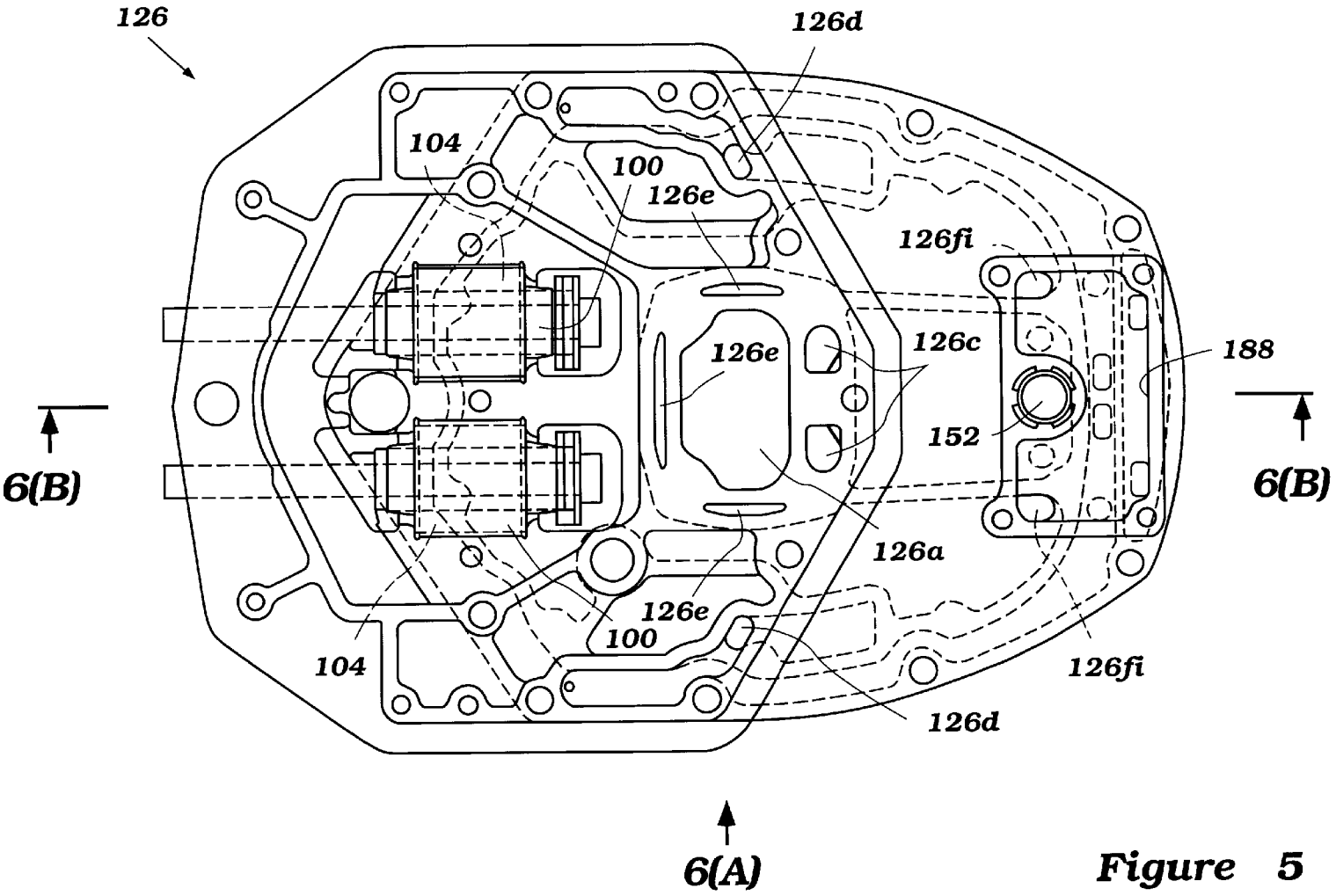
FIG. 5 is a top plan view showing the same exhaust guide member of FIG. 4 on which a pair of upper mount members are disposed.
Figure 6A:
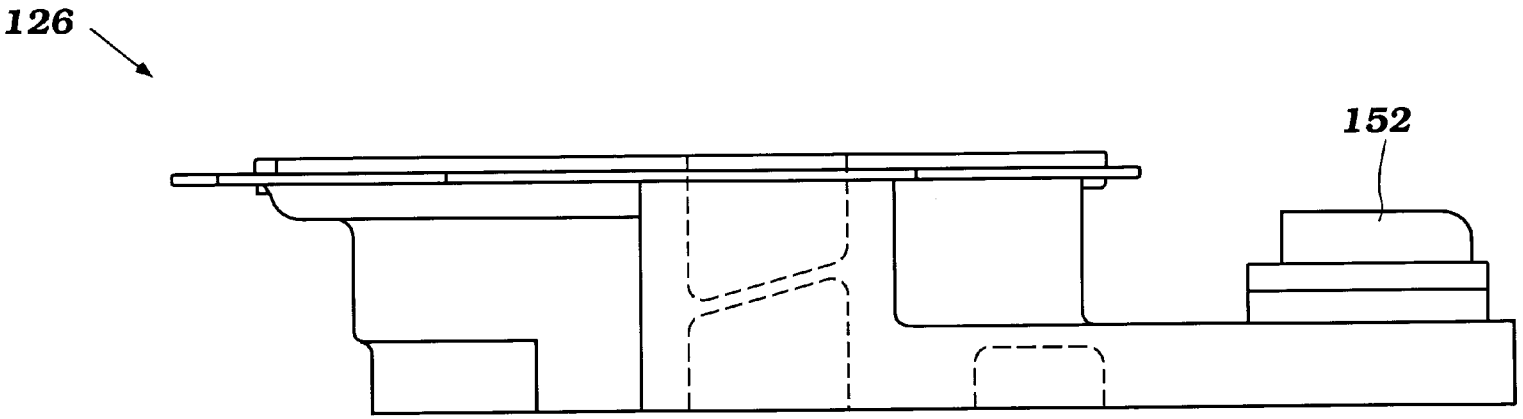
FIGS. 6(A) and 6(B) illustrate the exhaust guide member.
Figure 6B:
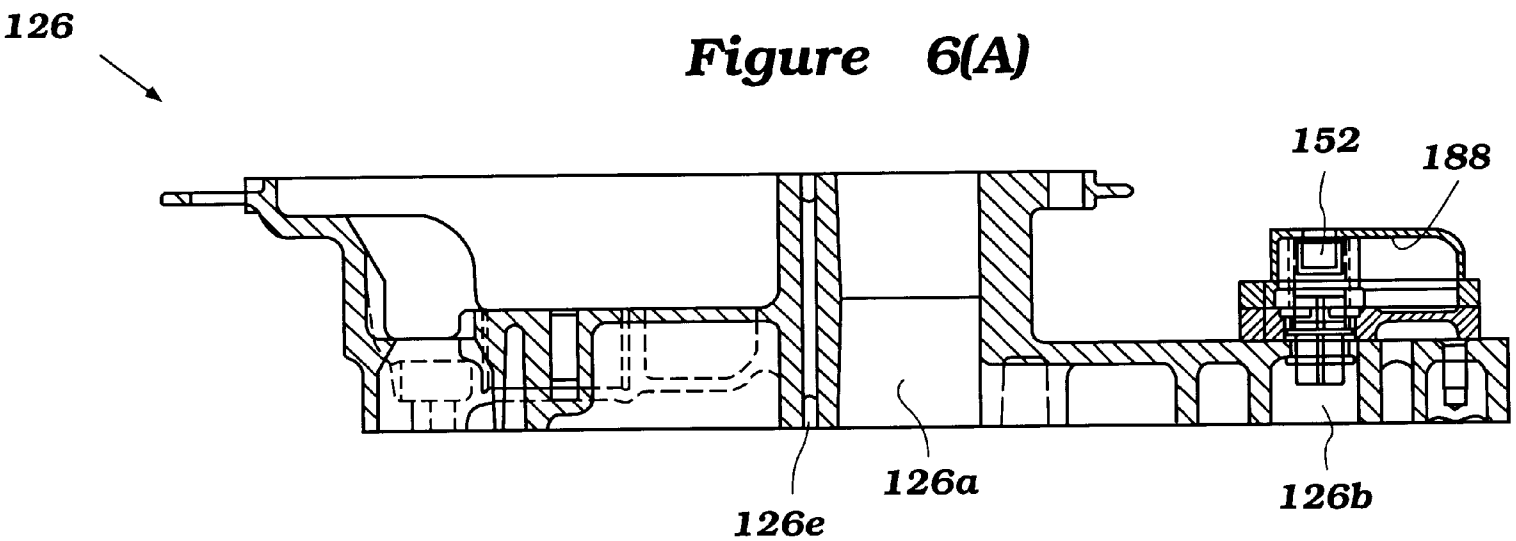
Figure 7:
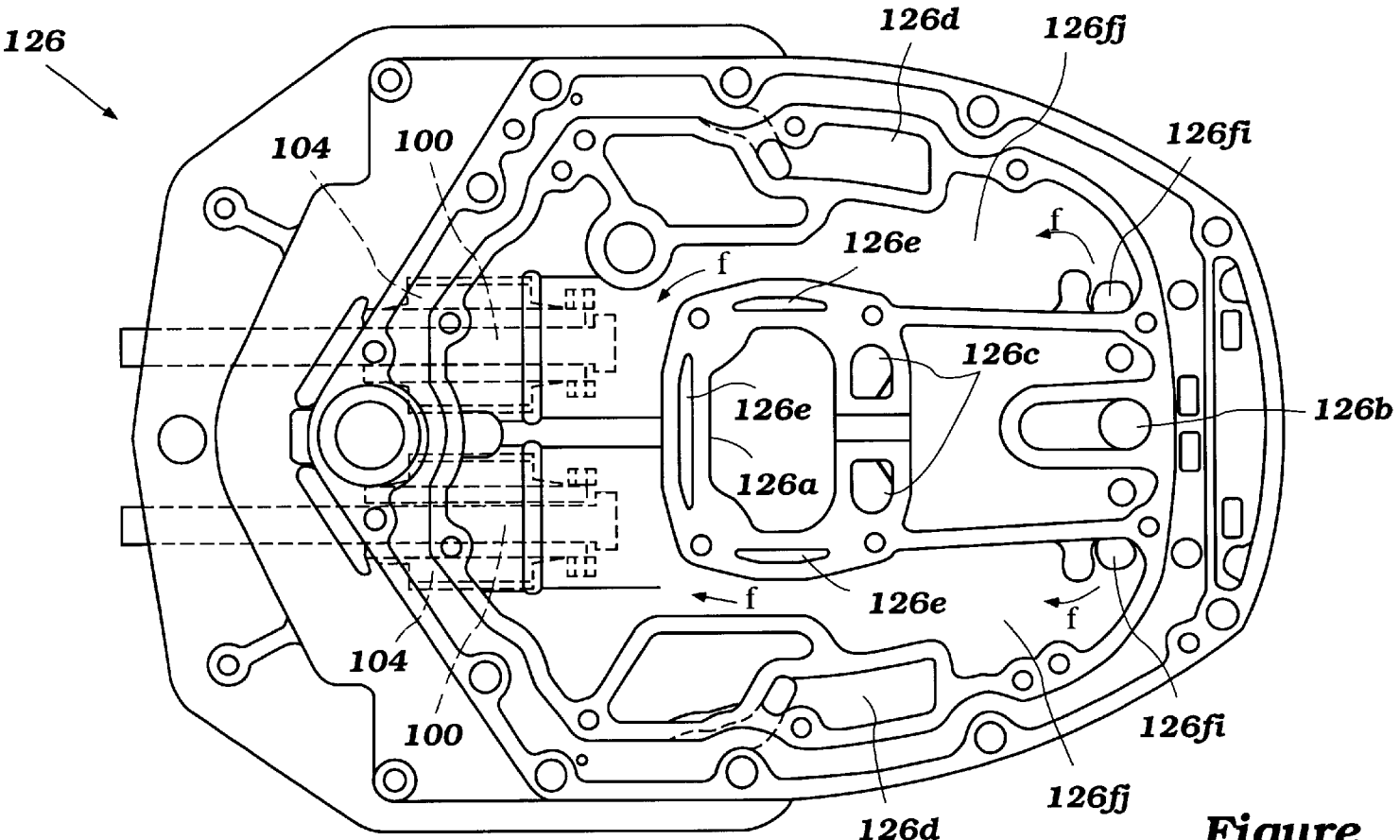
FIG. 7 is a bottom plan view showing the same exhaust guide member of FIG. 4 on which the pair of upper mount members are disposed.

As best seen in FIG. 3, the oil pan 138 is affixed to the cover member 140 by bolts 192 and anchored to the exhaust guide member 126 along with the cover member 140 and also the exhaust manifold 128 by bolts 194. The cover member 140 not only covers the oil pan 138 but also forms an upper transverse water jacket 126*fj* (see FIGS. 7 and 8(A)) with the exhaust guide member 126 therebetween. A pair of inlet ports 126*fi* for the water jacket 126*fj* are formed at both sides of the pressure control valve 152 in the valve chamber 188. A water channel 126*b* is also formed under the pressure control valve 152 (see FIG. 6) at the bottom of the exhaust guide member 126. The water flowing through the channel 126*b*, thus, passes through the pressure control valve 152 if it is opened and flows into the upper transverse water jacket 126*fj*. If the pressure control valve 152 is not opened, the water flowing the channel 126*b* goes to the channel (c) including the openings 126*c*. The channel (c) is formed in the cover member 140 as described shortly.

Figure 8A:
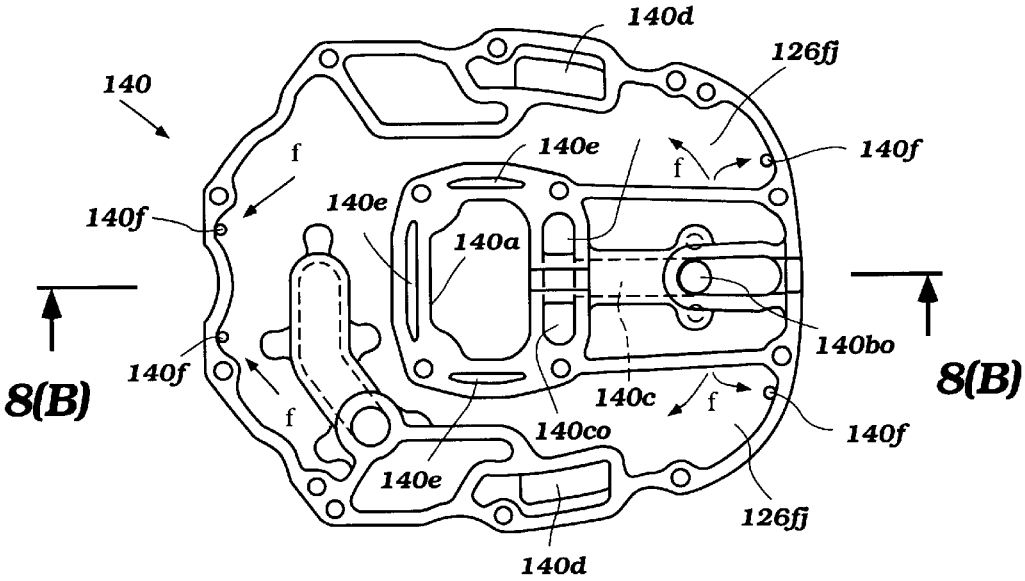
FIGS. 8(A), 8(B) and 8(C) illustrate a cover member which covers over an upper side of the oil pan.
Figure 8B:
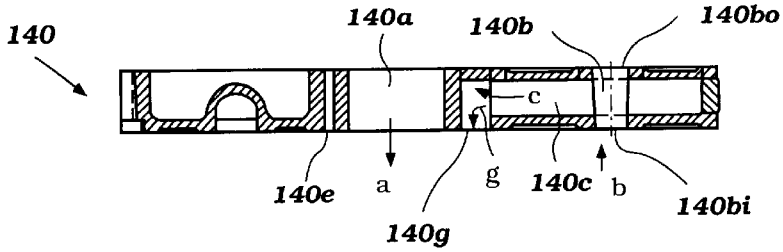
Figure 8C:
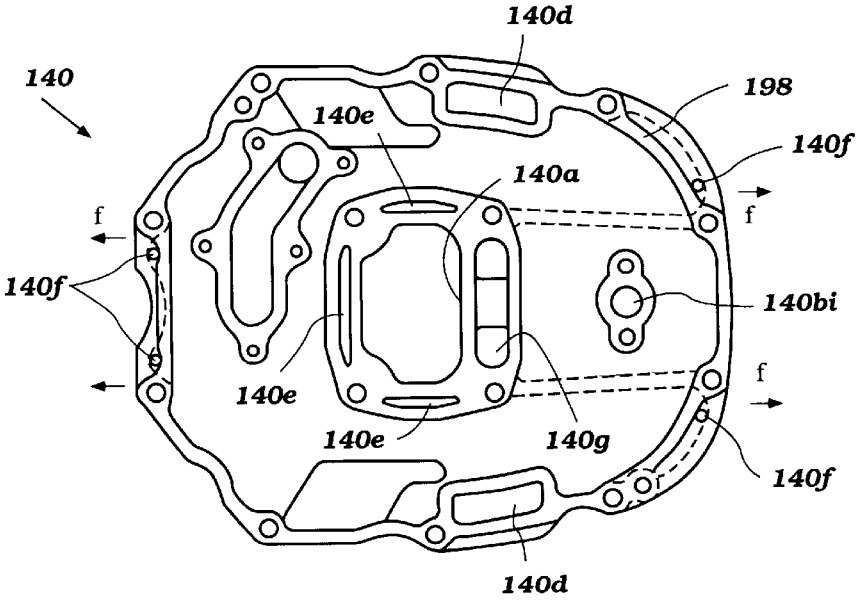

As seen in FIGS. 8(A), 8(B) and 8(C), the cover member 140 has a bore 140*a* communicating with the bore 126*a*, three slits 140*e* communicating with the slits 126*e* and a pair of openings 140*co* communicating with the openings 126*c*. The channel (c) or 140*c* is formed as a hollow passage and runs from the rear to the forward in the cover member 140. The water flows therethrough and goes out from the openings 140*co* toward the engine 38. A conduit 140*b* passes through the conduit 140*b* vertically and hence an inlet port 140*bi* and an outlet port 140*bo* are defined at both lower and upper ends. A pair of discharge openings 140*d* communicating with the discharge openings 126*d* are further formed at both outer sides of the lateral slits 140*e*. The conduit 140*c* has an opening 140*g* elongating transversely at its forward end bottom portion.

The upper transverse water jacket 126*fj* has a certain extent that can isolate the oil pan 138 from the upper mount 100 and extends generally horizontally. To put it more precisely, it slightly inclines forwardly. Drains 140*f* are formed at the most forward and rear portions of the jacket 126*fj*. The water flowing through the transverse water jacket 126*fj*, therefore, can remove the heat existing at the upper portion of the oil pan 138. Besides, the upper transverse jacket 126*fj* prevents the heat in the oil pan 138 from being radiated to the upper mount 100.

As seen in FIG. 8(C), the drains 140*f* exist out of a circular rib 198 which meets with a circular rib 200 (see FIG. 9(A)) of the oil pan 138 so that no water falls down into a lubricant reservoir 138*z* of the oil pan 138.

As described above, the oil pan 138 depends from the cover member 140. The lubricant reservoir 138*z* is configured generally as a circular shape so as to make the hollow 202 at its center portion. The hollow 202 narrows at its top portion to form an inner flange 204 there. An opening 138*a* still exists therein. Bolt holes 206 are provided at the four corners of the inner flange 204 and the bolts 194 are affixed therethrough. The exhaust manifold 128 extends generally vertically through the hollow 202.

Slits 138*e* communicating with the slits 140*e* of the cover member 140 are formed in front of the opening 138*a* and also both sides thereof. An aperture 138*g* communicating with the opening 140*g* is also formed behind the opening 138*a*. The water branched off from the channel (c) and passing through the slits 126*e*, 140*e*, 138*e*, the opening 140*g* and the aperture 138*g* falls down along the wall 166 of the hollow 202. This down flow of the water makes a water curtain between the wall 166 of the hollow 202 and the exhaust manifold 128. The heat that the exhaust manifold 128 as well as the exhaust gasses passing therethrough holds is prevented from conducting to the lubricant reservoir 138*z*.

The oil pan 138 has a periphery water jacket 138*k*. Actually, as best seen in FIG. 9(B), the periphery water jacket 138*k* consists of three jacket sections and generally surrounds the lubricant reservoir 138*z*. The periphery water jacket 138*k* is unitarily formed with the oil pan 138 and extends upwardly from the bottom of the oil pan 138 and almost halfway thereof.

Figure 10A:
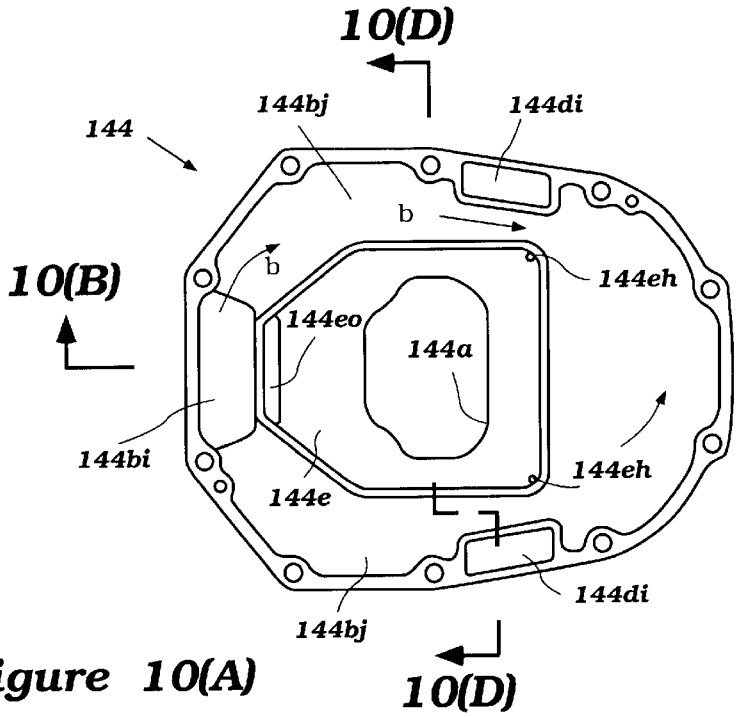
FIGS. 10(A), 10(B), 10(C) and 10(D) illustrate a lower plate attached to the bottom of the oil pan.
Figure 10D:
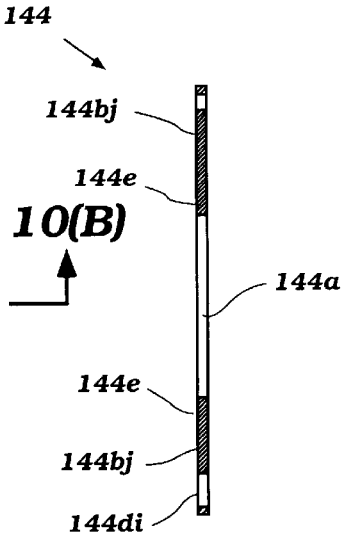
Figure 10B:
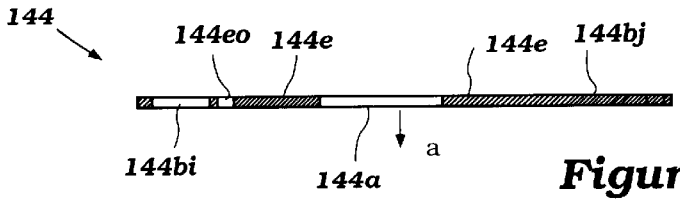
Figure 10C:
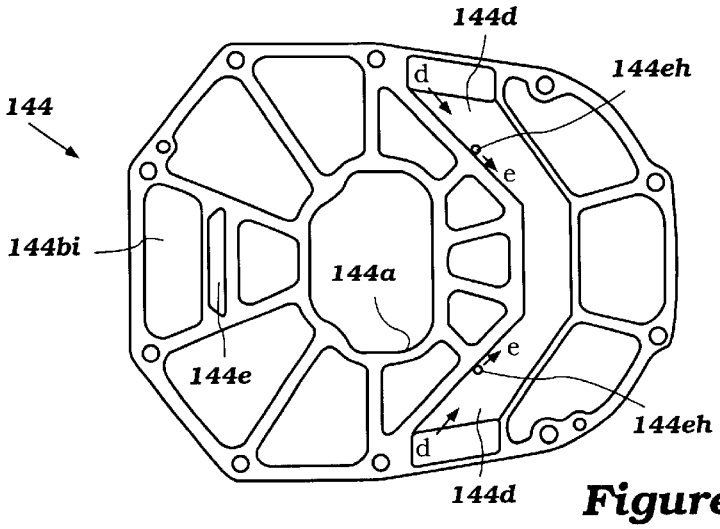

The water to the periphery water jacket 138*k* is supplied from the supply conduit 158 (see FIG. 3) through a lower transverse water jacket 144*bj* (see FIG. 10(A)) which is formed between the bottom of the oil pan 138 and the lower member 144. For this purpose, the lower member 144 is affixed to the oil pan 138 by bolts, although they are not shown. The lower transverse water jacket 144*bj* has a certain extent like the upper transverse water jacket 126*fj* and extends generally horizontally. It may slightly incline rearwardly.

Drains 138*ko* (see FIG. 3) are formed at each top portion of the jacket sections of the periphery water jacket 138*k* and the water overflowing in the periphery water jacket 138*k* is drained to the water pool 160 defined between the oil pan 138 and the driveshaft housing 32.

The periphery water jacket 138*k* is effective to remove the heat held by the oil pan 138 because it is unified with the oil pan 138 and fresh water is supplied thereto. The term "fresh" means that the water has not circulated within the engine 38 and is directly supplied from the water pump 150.

The oil pan 138 has an upstanding water passage 138*b* at the rear thereof. The remainder of the water that does not go to the periphery water jacket 138*k* flows into this upstanding water passage 138*b* and goes up toward the upper transverse water jacket 126*fj*. As a matter of course, the water passing through the upstanding passage 138*b* is fresh and hence the heat in the oil pan 138 is removed more effectively. Besides, the isolation of the upper mount 100 from the heat of the oil pan 138 is also achieved efficiently, because this fresh water may flow through the upper transverse water jacket 126*fj*.

The water drained to the water pool 160 from the periphery water jacket 138*k* is discharged to the second expansion chamber 132 or directly to the water outlet port 156 through apertures 205, 207 formed at almost the bottom portion of the driveshaft housing 32 (see FIG. 3). The water drained to the second expansion chamber 132 is discharged to the body of water surrounding the outboard motor 20 through the bore of the propeller 84 with exhaust gasses. Meanwhile, the water drained to the outlet port 156 is directly to the surrounding water. However, because the apertures 205, 207 are relatively small, usually the water accumulates in the water pool 160. An overflow port 160*do* (see FIG. 9(C)) is formed at nearly the top portion of the discharge passage 138*d* of the oil pan 138. When the water in the water pool 160 reaches the level of the overflow port 160*do*, it flows into the discharge passage 138*d*. The water pool 160 is particularly effective for preventing the driveshaft housing 32 from being discolored, although it is still effective for removing the heat of the oil pan 138.

The water discharge passages 138*d* extends downwardly therethrough. The discharge passages 138*d* communicate with the discharge openings 140*d* of the cover member 140. Thus, the water circulated around the engine water jackets flows down through the discharge openings 126*d* of the exhaust guide member 126, the discharge openings 140*d* of the cover member 140 and the discharge passages 138*d* toward the lower member 144.

As seen in FIG. 3, an oil strainer 208 is affixed to the bottom of the cover member 140 so as to exist in the lubricant reservoir 138*z*. A strainer element 210 is fitted at the inlet portion of the strainer 208. Lubricant in the oil pan 138 is supplied to the engine 38 through the strainer 210 by the lubricant pump 146. Foreign particles are removed by the strainer element 210 before entering the lubricant pump 146.

As seen, for example, in FIG. 10(A), the lower member 144 has a bore 144*a* communicating with the exhaust manifold 128 through which the exhaust gasses pass. Around the bore 144*a*, a water receiver 144*e* is formed. The water of the water curtain falling down along the wall 166 of the hollow 202 is received by this water receiver 144*e*. The water receiver 144*e* has a drain slit 144*eo* in front of the exhaust bore 144*a* and a pair of drain apertures 144*eh* at sidelong behind thereof. Further around the water receiver 144*e*, the lower transverse water jacket 144*bj* is formed. An inlet opening 144*bi* for the water jacket 144*bj* is provided at the most forward portion of the lower member 144.

The opposite side (bottom) of the lower member 144 is mated with the top of the exhaust expansion chamber member 131. A water discharge jacket 144*d* communicating with the discharge openings 144*di* is formed on this side with the exhaust expansion chamber member 131 so as to collect the drain behind the exhaust bore 144*a*. The drain apertures 144*eh* are also opened to the water discharge jacket 144*d*.

Figure 11A:
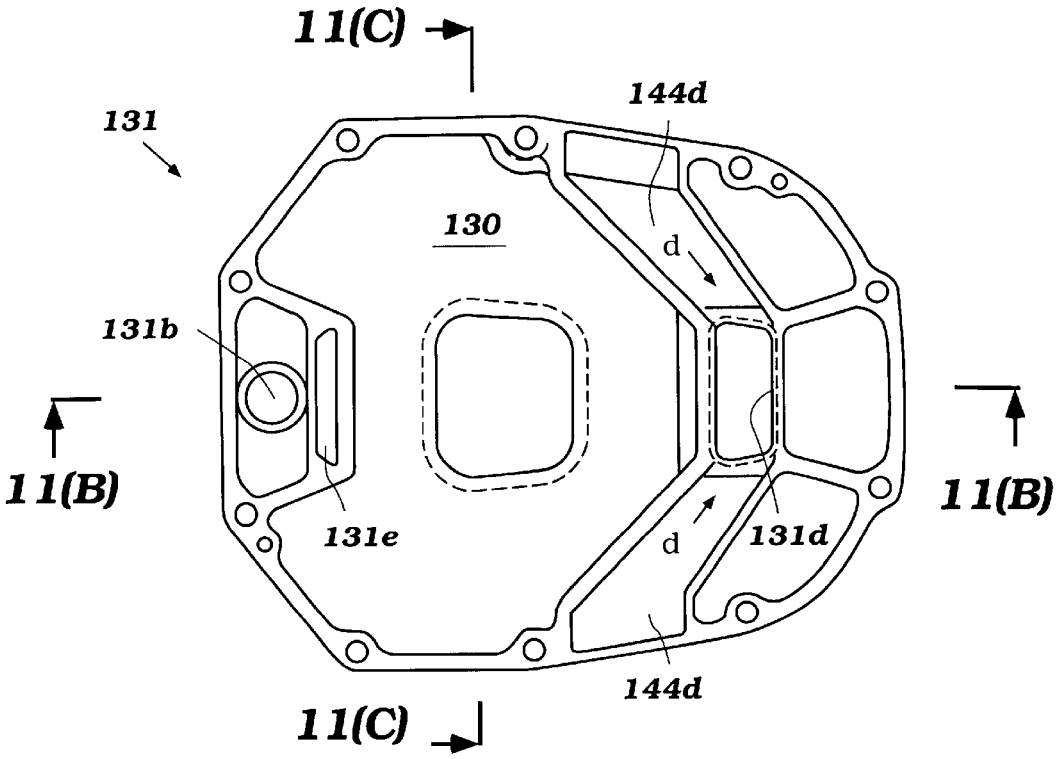
FIGS. 11(A), 11(B) and 11(C) illustrate a first exhaust expansion chamber member and are a top plan view, a cross-sectional side view taken along the line 11(B)—11(B) in FIG. 11(A) and a cross-sectional front view taken along the line 11(C)—11(C) in FIG. 11(A), respectively.
Figure 11B:
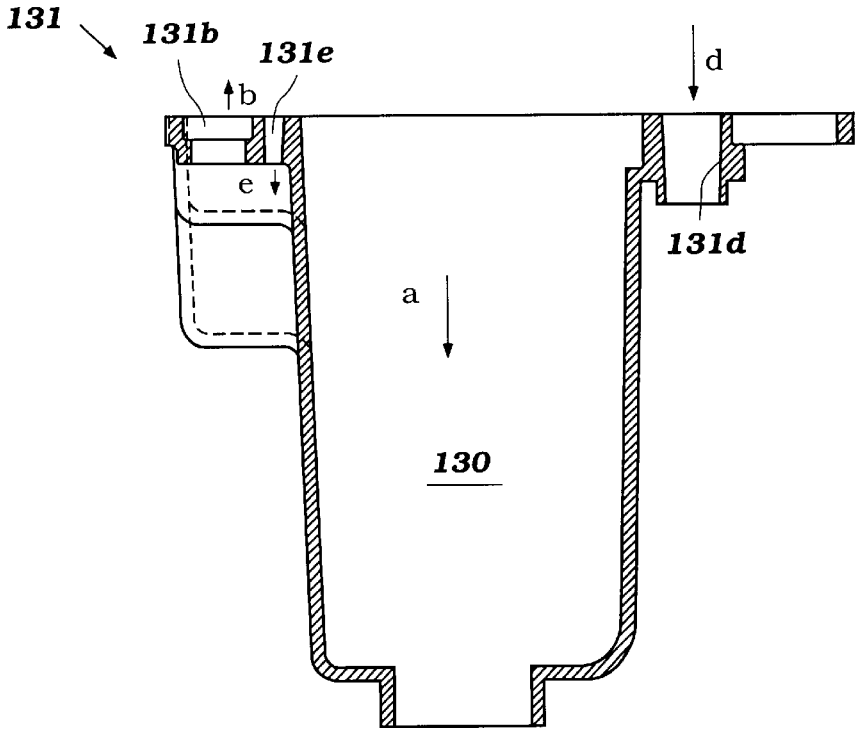
Figure 11C:
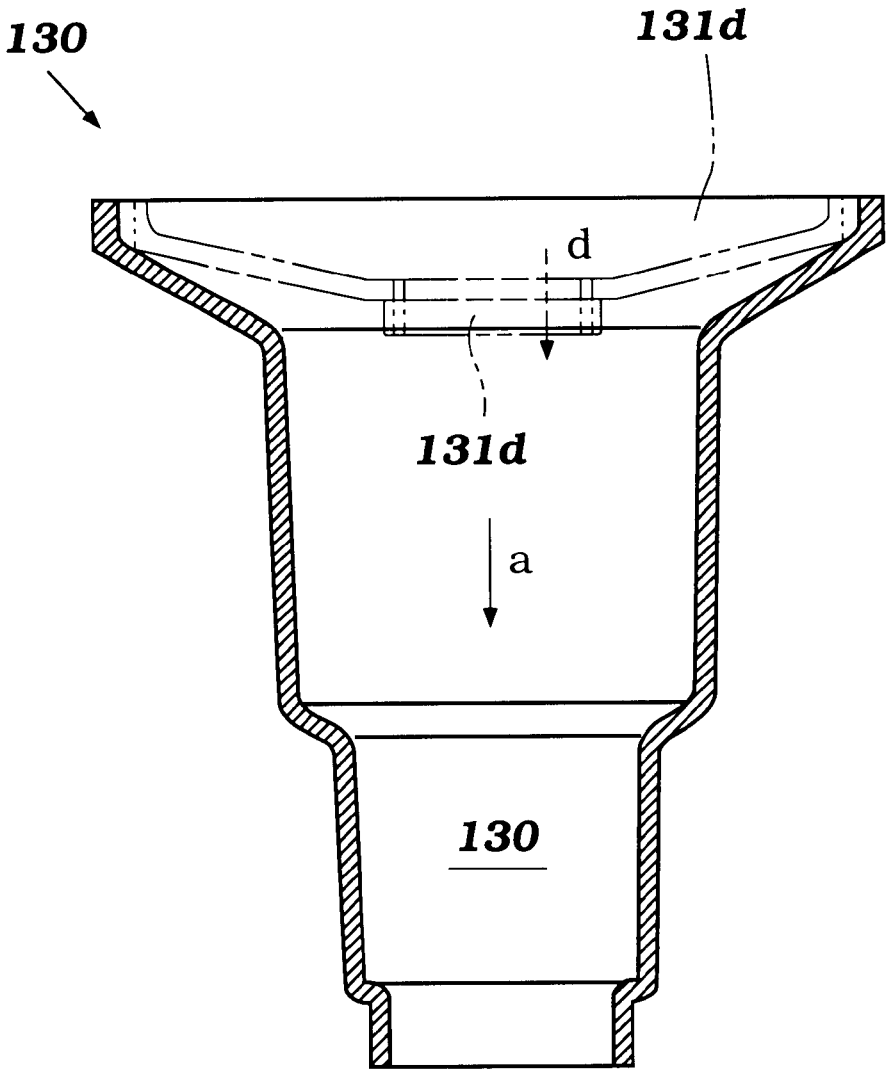

As seen in FIGS. 11(A) through 11(C), the exhaust expansion chamber member 131, in turn, has a discharge opening 131*d*. The discharge opening 131*d* is connected with the drain jacket 162 (see FIG. 3) in the driveshaft housing 32. The water going down through the drain jacket 162 is, then, discharged to the body of water surrounding the outboard motor 20 through the water outlet port 156 formed in the lower unit 34. The expansion chamber member 131 has also a slit 131*e* which communicates with the slit 144*e* of the lower member 144 and the water coming down through the slit 131*e* goes down to the second expansion chamber 132 through the aperture 205 and is finally discharged to the surrounding body of water.

At the most forward portion of the expansion chamber member 131, an opening 131*b* is formed and the top of the supply conduit 158 is fitted therein (see FIG. 3). The water passing up through the water conduit 158 is supplied to the lower transverse water jacket 144*bj*.

The first expansion chamber 130 is defined in the expansion chamber member 131 as described above. The capacity of the expansion chamber 130 is relatively large and the exhaust gasses passing through the exhaust manifold 128 is abruptly expanded in this chamber 130. Because of this, energy of the exhaust gasses is released and exhaust noise is reduced accordingly. The lower end of this chamber 130 is narrowed and the second expansion chamber 132 again has a large capacity. The same situation, therefore, occurs again in this second expansion chamber 132.

In summary, exhaust gasses from the engine 38 are collected by the exhaust manifold 128 and are directed down to the first exhaust expansion chamber 130 and then the second exhaust expansion chamber 132. Finally, they are discharged to the body of water surrounding the outboard motor 20 through the bore 134 formed in the hub of the propeller 84.

On the other hand, cooling water is introduced from the surrounding water through the water inlet port 154 by the water pump 150 and goes up to the lower transverse water jacket 144*bj* formed between the lower member 144 and the bottom of the oil pan 138 through the supply conduit 158. The water flows transversely below the oil pan 138 within the lower transverse water jacket 144*bj* and then primarily goes up to the engine 38 through the upstanding water passage 138*b*. Some of the water, however, goes to the periphery water jacket 138*k*. If the pressure control valve 152 is opened, the reminder of the water flows transversely through the upper transverse water jacket 126*fj* formed between the cover member 140 and the exhaust guide member 126.

Before going to the engine 38, some water is branched off and falls down through the slits 126*e*, 140*e*, 138*e*, the opening 140*g* and the aperture 130*g* along the wall 166 of the hollow 202 in the oil pan 138. By this flow, the water curtain is made. The water then goes down through the slit 144*e* or the drain jacket 162 to the apertures 205, 206 to be discharged.

The water discharged from the engine 38 goes down through the water discharge jacket comprising the openings 126*d*, 140*d* and the discharge passage 138*d*. The water discharge jacket bypasses the periphery water jacket 138*k*, the water pool 160 and the upper and lower transverse water jackets 126*fj*, 144*bj*.

The water in the periphery water jacket 138*k* is discharged to the water pool 160 through the drains 138*k*. Also, the water passing through the upper transverse water jacket 126*fj* is discharged to the water pool 160 through the drains 140*f*. Then, the water goes to the apertures 205, 207 to be discharged or flows into the discharge passage 138*d* through the overflow port 160*do* and then yes to the aperture 207.

As described above, the oil pan 138 is surrounded by the periphery water jacket 138*k* in one aspect of the present invention and the water pool 160 in another aspect thereof. The water curtain is also made to prevent the heat of the exhaust manifold 128 from conducting to the oil pan 138 in a further aspect of this invention. Also, the upper transverse water jacket 126*fj* and/or the lower transverse water jacket 144*bj* are provided in other aspects of the present invention. Further, the cooling water supplied to the engine 38 passes through the upstanding passage 138*b* which is disposed through the oil pan 138. No drain water from the engine 38 passes through these water jackets or flows as the water curtain. The water from the engine 38 rather flows through the water discharge jacket comprising the openings 126*d*, 140*d* and the discharge passage 138*d*. Thus, the oil pan 138 in the cooling system of the embodiment is cooled down more powerfully than in the conventional cooling system.

Also, the water pool 160 is defined between the oil pan 138 and the driveshaft housing 32 and the water into the water pool 160 has not been circulated within the engine 38. This water pool 160 can, therefore, prevent the driveshaft housing 32 from becoming discolored.

Further, the upper transverse water jacket 126*fj* is disposed above the oil pan 138 and hence the radiant heat of the oil pan 138 is precluded from being radiated to the components within the protective cowling 40. The components cannot be jeopardized by the heat of the oil pan 138. If the upper mount 100 is positioned above the upper transverse water jacket 126*fj* like in this embodiment, the elastic members 104 of the upper transverse water jacket 126*fj* is also prevented from being deteriorated by the heat of the oil pan 138. In other words, the elastic members 104 should not have greater heat-resistance. The nature of anti-vibration can be given much priority in selecting a material for the elastic member 104.

Although this invention has been described in terms of a certain preferred embodiment, other embodiments apparent to those of ordinary skill in the art are also within the scope of this invention. Accordingly, the scope of the invention is intended to be defined only by the claims that follow.

What is claimed is:

1. An outboard motor comprising an internal combustion engine, an oil pan depending from said engine and containing lubricant for lubrication of said engine, a cooling system cooling at least said engine and said oil pan, said cooling system including a periphery coolant jacket generally juxtaposing at least two sides of said oil pan and being supplied with coolant that has not cooled said engine, the oil pan comprising an outer wall having a first wall portion and a second wall portion which are unitarily formed with the oil pan, the first and second wall portions being disposed adjacent one another and having a space defined therebetween, the periphery coolant jacket being disposed in the space between the first and second outer wall portions, and a coolant discharge jacket bypassing said periphery coolant jacket, the coolant discharge jacket receiving coolant from the engine.

2. An outboard motor as set forth in claim 1, wherein said coolant discharge jacket is unitarily formed with said oil pan.

3. An outboard motor as set forth in claim 1, wherein said cooling system further includes an upstanding coolant passage extending generally vertically through said oil pan, and said cooling system supplies coolant to said engine through said upstanding coolant passage.

4. An outboard motor as set forth in claim 1, wherein said cooling system further includes a water pump for delivering water to both of said engine and said periphery coolant jacket.

5. An outboard motor as set forth in claim 1 additionally comprising a power head including said engine, and a housing depending from said power head, said coolant discharge jacket being spaced apart from said housing.

6. An outboard motor as set forth in claim 1 additionally comprising a power head having said engine, a housing depending from said power head and containing said oil pan therein, and said oil pan being spaced from said housing to define a coolant pool there between so that the coolant pool substantially surrounds at least a portion of the periphery water jacket, and said coolant pool is supplied with coolant.

7. An outboard motor as set forth in claim 6, wherein said periphery coolant jacket communicates with said coolant pool, and the coolant in said periphery coolant jacket is delivered to said coolant pool.

8. An outboard motor as set forth in claim 1, wherein said outboard motor further comprises an exhaust system to discharge exhaust gasses from said engine, said exhaust system includes an exhaust passage passing through said oil pan, and said cooling system further includes means for forming a heat sink between said exhaust passage and said oil pan when said engine is operated, said means being separate from the periphery coolant jacket.

9. An outboard motor as set forth in claim 1, wherein said engine operates on a four stroke principle.

10. An outboard motor comprising an internal combustion engine, an oil pan depending from said engine and containing lubricant for lubrication of said engine, a cooling system cooling at least said engine and said oil pan, said cooling system including a periphery coolant jacket generally juxtaposing at least a portion of said oil pan and being supplied with coolant that has not cooled said engine, said cooling system further including an upper coolant jacket extending generally transversely above said oil pan and being supplied with coolant, and a coolant discharge jacket bypassing said periphery coolant jacket, said coolant discharge jacket receiving coolant from said engine.

11. An outboard motor as set forth in claim 10, wherein said periphery coolant jacket generally juxtaposes at least two sides of said oil pan.

12. An outboard motor as set forth in claim 11, wherein said periphery coolant jacket generally juxtaposes at least two sides of said oil pan.

13. An outboard motor comprising an internal combustion engine, an oil pan depending from said engine and containing lubricant for lubrication of said engine, a cooling system cooling at least said engine and said oil pan, said cooling system including a periphery coolant jacket generally juxtaposing at least a portion of said oil pan and being supplied with coolant that has not cooled said engine, said cooling system further including a lower coolant jacket extending generally transversely below said oil pan and being supplied with coolant, the lower coolant jacket formed between the oil pan and a lower member, the lower member being inclined so that coolant flows generally upwardly through the lower coolant jacket, and a coolant discharge jacket bypassing said periphery coolant jacket, the coolant discharge jacket receiving coolant from the engine.

14. An outboard motor comprising an internal combustion engine, an oil pan depending from said engine and containing lubricant for lubrication of said engine, and a cooling system to cool at least said engine and said oil pan, said cooling system including an upstanding coolant passage extending generally vertically through said oil pan, said cooling system supplying coolant to said engine through said upstanding coolant passage, said cooling system further including an upper coolant jacket extending generally transversely above said oil pan and being supplied with coolant.

15. An outboard motor as set forth in claim 14, wherein said upstanding coolant passage is unitarily formed with said oil pan.

16. An outboard motor as set forth in claim 14, wherein said cooling system further includes a lower coolant jacket extending generally transversely below said oil pan and being supplied with coolant.

17. An outboard motor as set forth in claim 16, wherein the coolant passing through said lower coolant jacket is supplied to said engine through said upstanding coolant passage.

18. An outboard motor as set forth in claim 14, wherein said outboard motor further comprises an exhaust system to discharge exhaust gasses from said engine, said exhaust system includes an exhaust passage passing through said oil pan, and said cooling system further includes means for forming a heat sink between said exhaust passage and said oil pan when said engine is operated.

19. An outboard motor comprising a power head including an internal combustion engine, a housing depending from said power head and containing an oil pan therein, said oil pan depending from said engine and containing lubricant for lubrication of said engine, a cooling system to cool at least said engine and said oil pan, said cooling system including an upstanding coolant passage extending generally vertically through said oil pan, said cooling system supplying coolant to said engine through said upstanding coolant passage, said oil pan having an integrally formed water jacket configured to generally juxtapose at least two sides of the oil pan, and said oil pan being spaced apart from said housing to define a coolant pool between the oil pan water jacket and the housing.

20. An outboard motor as set forth in claim 19, wherein the cooling system further includes an upper coolant jacket extending generally transversely above said oil pan and being supplied with coolant.

21. An outboard motor comprising a power head having an internal combustion engine, a housing depending from said power head and containing a propulsion device driven by said engine for propelling an associated watercraft, an oil pan containing lubricant for lubrication of said engine, said oil pan depending into said housing and spaced apart from said housing, and a cooling system to cool at least said engine and said oil pan, said cooling system including a periphery cooling jacket surrounding at least two sides of the oil pan and a coolant pool defined between said oil pan periphery coolant jacket and said housing, said cooling system also including a coolant supply conduit that communicates with the engine and with the periphery coolant jacket such that coolant that has not cooled said engine is supplied to said periphery coolant jacket, said periphery coolant jacket having an outlet for delivering coolant to the coolant pool, said cooling system further including a coolant discharge jacket bypassing said periphery coolant jacket and coolant pool and arranged within the cooling system to receive coolant that has cooled said engine.

22. An outboard motor as set forth in claim 21, wherein the coolant in said coolant pool is discharged to said coolant discharge jacket.

23. An outboard motor as set forth in claim 22, wherein said coolant pool communicates with said coolant discharge jacket through an overflow port, and the coolant in said coolant pool overflows to said discharge jacket through said overflow port.

24. An outboard motor as set forth in claim 21, wherein said discharge jacket is unitarily formed with said oil pan.

25. An outboard motor as set forth in claim 21, wherein said outboard motor further comprises an exhaust system for discharging exhaust gasses from said engine, said exhaust system includes an exhaust passage passing through said oil pan, and said cooling system further includes means for forming a heat sink between said exhaust passage and said oil pan when said engine is operated.

26. An outboard motor as set forth in claim 21, wherein said cooling system additionally includes an upper coolant jacket extending generally transversely above said oil pan and supplied with coolant.

27. An outboard motor as set forth in claim 21, wherein said cooling system additionally includes a lower coolant jacket extending generally transversely below said oil pan and supplied with coolant.

28. An outboard motor comprising an internal combustion engine, an oil pan depending from said engine and containing lubricant for lubrication of said engine, an exhaust system for discharging exhaust gasses from said engine, said exhaust system including an exhaust passage passing through said oil pan, a cooling system for cooling at least said engine and said oil pan, and said cooling system including means for forming a heat sink between said exhaust passage and said oil pan when said engine is operated, said cooling system further including an upper coolant jacket extending generally transversely above said oil pan.

29. An outboard motor as set forth in claim 28, wherein said exhaust passage includes a passage member depending from an exhaust guide member affixed to said engine, said upper coolant jacket is formed with jacket members including said exhaust guide member, said cooling system further includes a pressure control valve for regulating pressure of the coolant to said engine, and said pressure control valve is attached to said exhaust guide member.

30. An outboard motor as set forth in claim 28, wherein said means arranged to receive coolant for a coolant jacket of said engine.

31. An outboard motor comprising an internal combustion engine, an oil pan depending from said engine and containing lubricant for lubrication of said engine, a cooling system for cooling at least said engine and said oil pan, said cooling system including an upper transverse coolant jacket extending generally transversely above said oil pan, and said cooling system supplying coolant that has not cooled said engine to the upper transverse coolant jacket, and said cooling system further including a coolant discharge jacket bypassing said upper transverse coolant jacket and arranged to receive coolant from the engine.

32. An outboard motor as set forth in claim 31 additionally comprising a power head having said engine, a housing depending from said power head and containing said oil pan therein, said housing having at least one support member affixed thereto, a bracket assembly for mounting said housing on an associated watercraft at said support member for pivotal movement at least about a steering axis, and said upper transverse coolant jacket being positioned between said oil pan and said support member.

33. An outboard motor as set forth in claim 32, wherein said support member is affixed to said housing by an elastic element.

34. An outboard motor as set forth in claim 31 additionally comprising a power head having said engine, a housing depending from said power head and containing said oil pan therein, and said upper transverse coolant jacket being positioned between said oil pan and said engine.

35. An outboard motor as set forth in claim 31, wherein said upper transverse coolant jacket is configured generally to isolate thermally said oil pan from said support member.

36. An outboard motor as set forth in claim 31, wherein said cooling system further includes a pressure control valve for regulating pressure of the coolant to said engine, and the coolant from said pressure control valve is disposed upstream of said transverse coolant jacket.

37. An outboard motor as set forth in claim 31, wherein said upper transverse coolant jacket is formed with upper jacket members that includes a cover member of said oil pan.

38. An outboard motor as set forth in claim 37, wherein said cooling system further includes a pressure control valve for regulating pressure of the coolant to said engine, and said pressure control valve is disposed on said upper jacket members.

39. An outboard motor as set forth in claim 31, wherein said cooling system further includes a lower transverse coolant jacket extending generally transversely below said oil pan.

40. An outboard motor comprising an internal combustion engine, an oil pan depending from said engine and containing lubricant for lubrication of said engine, an exhaust system to discharge exhaust gasses from said engine, said exhaust system including an exhaust passage passing through said oil pan, and a cooling system for cooling at least said engine and said oil pan, said cooling system including a lower transverse coolant jacket extending generally transversely below said oil pan, said cooling system arranged to supply coolant to said engine through said lower transverse coolant jacket, said lower transverse coolant jacket having an inlet port and an outlet port which are disposed opposite to each other on opposite sides of said exhaust passage, and said cooling system further including a coolant discharge jacket arranged to bypass said lower transverse coolant jacket and arranged within the cooling system to receive coolant from said engine.

41. An outboard motor as set forth in claim 40, wherein said lower transverse coolant jacket is formed with lower jacket members including a lower member attached to said oil pan.

42. An outboard motor comprising an internal combustion engine, an oil pan depending from said engine and containing lubricant to lubricate said engine, and a cooling system arranged to cool at least said engine and said oil pan, said cooling system including a periphery coolant jacket generally surrounding said oil pan and being unitarily formed with the oil pan, a coolant supply conduit arranged to communicate with the engine and with the periphery coolant jacket such that coolant that has not cooled said engine is supplied to said periphery coolant jacket, and a coolant discharge jacket arranged to bypass said periphery coolant jacket, the coolant discharge jacket arranged to receive coolant from the engine.

43. An outboard motor comprising an internal combustion engine, an oil pan depending from said engine and containing lubricant for lubrication of said engine, and a cooling system to cool at least said engine and said oil pan, said cooling system including an upstanding coolant passage extending generally vertically through said oil pan, said cooling system supplying coolant to said engine through said upstanding coolant passage, said cooling system further including an upper coolant jacket extending generally transversely above said oil pan and being supplied with coolant, said cooling system additionally including a lower coolant jacket extending generally transversely below said oil pan and being supplied with coolant.

44. An outboard motor as set forth in claim 43, wherein the coolant passing through said lower coolant jacket is supplied to said engine through said upstanding coolant passage.

45. An outboard motor as set forth in claim 43, wherein the upper coolant jacket is selectively engagable.

46. An outboard motor as set forth in claim 43, wherein the upper coolant jacket is inclined.

47. An outboard motor comprising a power head having an internal combustion engine, a housing depending from said power head and containing a propulsion device driven by said engine for propelling an associated watercraft, an oil pan containing lubricant for lubrication of said engine, said oil pan depending into said housing and spaced apart from said housing, and a cooling system to cool at least said engine and said oil pan, said cooling system including a coolant pool defined between said oil pan and said housing, said cooling system also including a coolant supply conduit that communicates with the engine and with the coolant pool such that coolant that has not cooled said engine is supplied to said coolant pool, said cooling system further including a coolant discharge jacket bypassing said coolant pool and arranged within the cooling system to receive coolant that has cooled said engine, wherein the coolant in said coolant pool is discharged to said coolant discharge jacket.

48. An outboard motor as set forth in claim 47, wherein said coolant pool communicates with said coolant discharge jacket through an overflow port, and the coolant in said coolant pool overflows to said discharge jacket through said overflow port.

49. An outboard motor as set forth in claim 47 additionally comprising an oil pan coolant jacket, and the oil pan coolant jacket supplies coolant to the coolant pool.

50. An outboard motor comprising a power head having an internal combustion engine, a housing depending from said power head and containing a propulsion device driven by said engine for propelling an associated watercraft, an oil pan containing lubricant for lubrication of said engine, said oil pan depending into said housing and spaced apart from said housing, and a cooling system to cool at least said engine and said oil pan, said cooling system including a coolant pool defined between said oil pan and said housing, said cooling system also including a coolant supply conduit that communicates with the engine and with the coolant pool such that coolant that has not cooled said engine is supplied to said coolant pool, said cooling system further including a coolant discharge jacket bypassing said coolant pool and arranged within the cooling system to receive coolant that has cooled said engine, said cooling system additionally including an upper coolant jacket extending generally transversely above said oil pan and supplied with coolant.

51. An outboard motor comprising a power head having an internal combustion engine, a housing depending from said power head and containing a propulsion device driven by said engine for propelling an associated watercraft, an oil pan containing lubricant for lubrication of said engine, said oil pan depending into said housing and spaced apart from said housing, and a cooling system to cool at least said engine and said oil pan, said cooling system including a coolant pool defined between said oil pan and said housing, said cooling system also including a coolant supply conduit that communicates with the engine and with the coolant pool such that coolant that has not cooled said engine is supplied to said coolant pool, said cooling system further including a coolant discharge jacket bypassing said coolant pool and arranged within the cooling system to receive coolant that has cooled said engine, said cooling system additionally including a lower coolant jacket extending generally transversely below said oil pan and supplied with coolant.

52. An outboard motor comprising an internal combustion engine, an oil pan depending from said engine and containing lubricant for lubrication of said engine, a cooling system cooling at least said engine and said oil pan, said cooling system including a periphery coolant jacket generally juxtaposing at least two sides of said oil pan and being supplied with coolant that has not cooled said engine, said cooling system further including an upper coolant jacket extending generally transversely above said oil pan and being supplied with coolant, and a coolant discharge jacket bypassing said periphery coolant jacket, said coolant discharge jacket receiving coolant from said engine.

53. An outboard motor comprising a power head including an internal combustion engine, a housing depending from said power head and containing an oil pan therein, said oil pan depending from said engine and containing lubricant for lubrication of said engine, a cooling system to cool at least said engine and said oil pan, said cooling system including an upstanding coolant passage extending generally vertically through said oil pan, said cooling system supplying coolant to said engine through said upstanding coolant passage, and said oil pan being spaced apart from said housing to define a coolant pool between the oil pan and the housing, wherein the cooling system further includes an upper coolant jacket extending generally transversely above said oil pan and being supplied with coolant.

54. An outboard motor configured to be mounted on an associated watercraft, the outboard motor comprising an internal combustion engine, an oil pan depending from the engine and containing lubricant for lubrication of the engine, a cooling system for cooling at least the engine and the oil pan, a bracket assembly for mounting the motor on the watercraft, and a support member configured to engage the bracket assembly so that the motor is pivotable relative to the bracket assembly about a steering axis, and the cooling system comprises a coolant jacket arranged generally transversely above the oil pan and between the oil pan and the support member, the cooling system supplying coolant to the coolant jacket.

55. The outboard motor of claim 54, wherein the coolant jacket is arranged generally between the engine and the oil pan.

56. The outboard motor of claim 54, wherein the coolant jacket is generally horizontal.

57. The outboard motor of claim 56, wherein the coolant jacket is slightly inclined.

58. The outboard motor of claim 54, wherein the coolant jacket is selectively provided with coolant from the cooling system.

59. The outboard motor of claim 58, wherein the cooling system has a control valve upstream of the coolant jacket.

60. The outboard motor of claim 56, wherein the cooling system supplies the coolant jacket with coolant that has not cooled the engine.

61. The outboard motor of claim 54, wherein the support member comprises an elastic element.

* * * * *